US010946651B2

(12) United States Patent
Martin et al.

(10) Patent No.: US 10,946,651 B2
(45) Date of Patent: Mar. 16, 2021

(54) FLUIDIC DIE SENSE ARCHITECTURE

(71) Applicant: HEWLETT-PACKARD DEVELOPMENT COMPANY, L.P., Spring, TX (US)

(72) Inventors: Eric Martin, Corvallis, OR (US); James Gardner, Corvallis, OR (US); Rogelio Cicili, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/619,341

(22) PCT Filed: Jul. 20, 2017

(86) PCT No.: PCT/US2017/043066
§ 371 (c)(1),
(2) Date: Dec. 4, 2019

(87) PCT Pub. No.: WO2019/017951
PCT Pub. Date: Jan. 24, 2019

(65) Prior Publication Data
US 2020/0139709 A1 May 7, 2020

(51) Int. Cl.
*B41J 2/14* (2006.01)
*B41J 2/045* (2006.01)

(52) U.S. Cl.
CPC ..... *B41J 2/14153* (2013.01); *B41J 2/0451* (2013.01); *B41J 2/0458* (2013.01); (Continued)

(58) Field of Classification Search
CPC ..... B41J 2/14153; B41J 2/04563; B41J 2/04521; B41J 2/04543
See application file for complete search history.

(56) References Cited

U.S. PATENT DOCUMENTS 8,807,694 B2 8/2014 Beng Keong et al.
2005/0242980 A1 11/2005 Collins et al.
(Continued)

FOREIGN PATENT DOCUMENTS

CN 106061743 A * 10/2016 ..... B41J 2/1412
CN 107428167 A * 12/2017 ..... B41J 2/04541
(Continued)

OTHER PUBLICATIONS

Chang, C.M. et al., Inkjet Printhead Arrays with No Separating Wall Between Bubbles, Jun. 10-14, 2007 < http://ieeexplore.ieee.org/document/4300099/ >.

*Primary Examiner* — Julian D Huffman
(74) *Attorney, Agent, or Firm* — Dicke Billig & Czaja PLLC

(57) ABSTRACT

A fluidic die includes a sense architecture having a global sense block to provide an analog reference signal and an array of distributed sense blocks. Each distributed sense block is to receive a same set of addresses via an address bus and each is to receive a corresponding sense enable signal having an enable value or a disable value. Each distributed sense block includes an array of sensors, each sensor corresponding to a different address of the set of addresses and a sample circuit to apply the analog reference signal to the sensor corresponding to the address on the address bus when the corresponding sense enable signal has the enable value, and provide to the global sense block an analog sense signal from the sensor resulting from application of the analog reference signal.

15 Claims, 4 Drawing Sheets

(52) U.S. Cl.
CPC ..... *B41J 2/04521* (2013.01); *B41J 2/04543* (2013.01); *B41J 2/04563* (2013.01); *B41J 2/04573* (2013.01); *B41J 2/04588* (2013.01)

(56) References Cited

U.S. PATENT DOCUMENTS

| | | | | |
|---|---|---|---|---|
| 2006/0274103 | A1* | 12/2006 | Kim | B41J 2/04563 347/17 |
| 2007/0291066 | A1* | 12/2007 | Takabayashi | B41J 2/17509 347/17 |
| 2017/0043584 | A1 | 2/2017 | Fricke et al. | |

FOREIGN PATENT DOCUMENTS

| | | | |
|---|---|---|---|
| WO | WO-2014084843 | A1 | 6/2014 |
| WO | WO-2016068872 | A1 | 5/2016 |
| WO | WO-2016068888 | A1 | 5/2016 |
| WO | WO-2016068900 | A1 | 5/2016 |

* cited by examiner

FLUIDIC DIE SENSE ARCHITECTURE

BACKGROUND

Fluidic dies may include an array of nozzles, where each nozzle includes a fluid chamber, a nozzle orifice, and a fluid actuator, where the fluid actuators may be actuated to cause displacement of fluid and cause ejection of fluid drops from the nozzle orifices to produce an article. Some example fluidic dies may be printheads where the fluid may correspond to ink. Fluidic dies may include sensors, or arrays of sensors, to monitor operation of the fluidic die.

Figure 1:
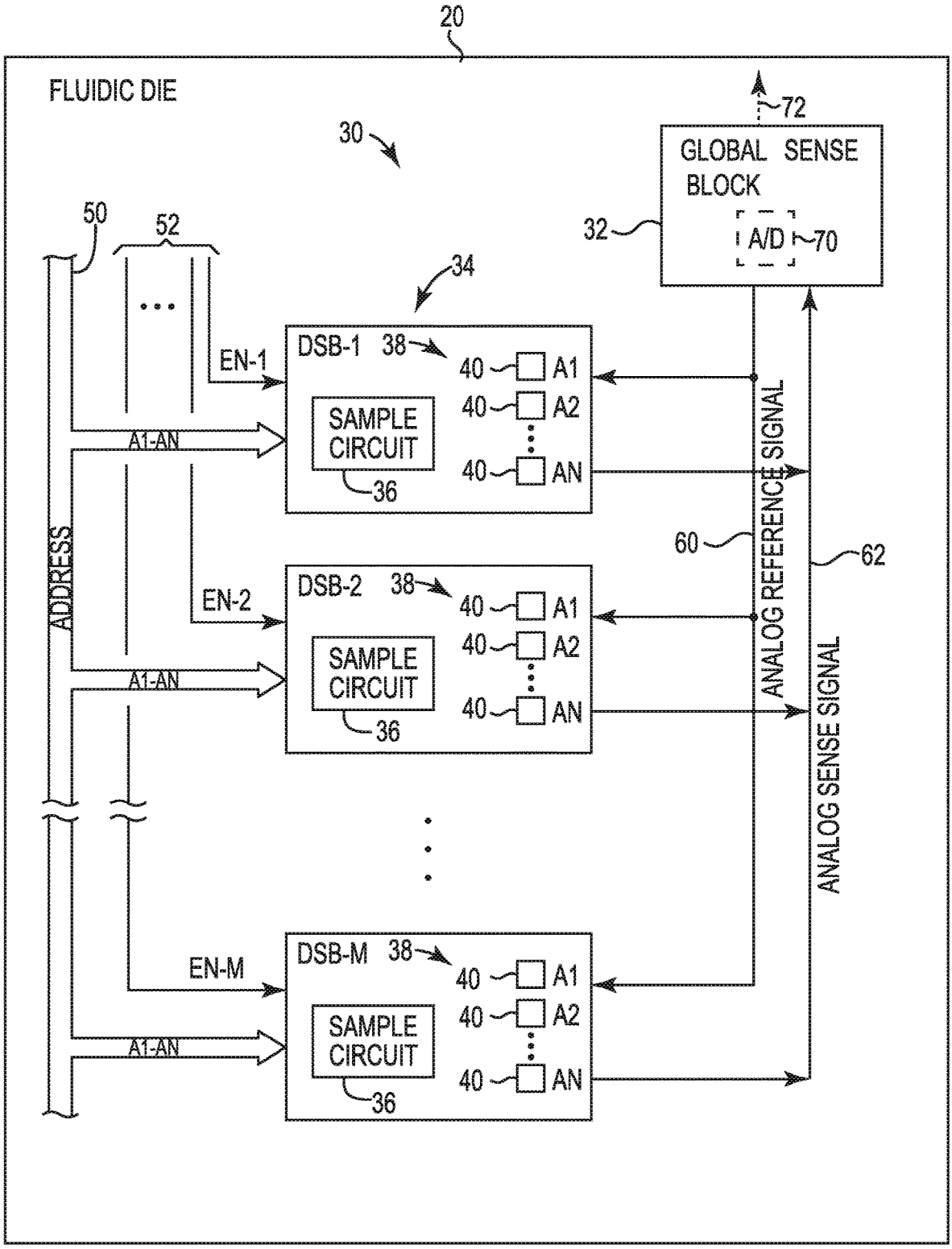
FIG. 1 is a block and schematic diagram of a fluidic die having a sense architecture, according to one example.

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims. It is to be understood that features of the various examples described herein may be combined, in part or whole, with each other, unless specifically noted otherwise.

Fluidic dies may include a number of fluid actuators. The fluidic actuators may include a piezoelectric membrane based actuator, a thermal resistor based actuator, an electrostatic membrane actuator, a mechanical/impact driven membrane actuator, a magneto-strictive actuator, or other suitable element that may cause displacement of fluid in response to electrical actuation. In some examples, a fluid actuator may be disposed in a nozzle, where in addition to the fluid actuator, the nozzle may comprise a fluid chamber and a nozzle orifice, where actuation of the fluid actuator displaces fluid in the fluid chamber to cause ejection of a fluid drop from the nozzle orifice. Accordingly, a fluid actuator disposed in a nozzle may be referred to as a fluid ejector or drop ejector.

In some examples, a fluid actuator may be disposed in fluid channels, chambers, or other suitable structures, which facilitate conveyance of fluid within the fluidic die, such as to nozzle fluid chambers, for example. In such implementations, actuation of a fluid actuator may displace and control movement of fluid to desired locations within the fluidic die. Accordingly, a fluid actuator disposed in a fluidic channel or other such structure may be referred to as a fluid pump or simply as a pump.

The plurality of fluid actuators of a fluidic die may be referred to as an array of fluid actuators. In one example, the array of fluid actuators may be arranged in a column. Fluid actuators of the array of fluid actuators may be selectively actuated to cause fluid drops to be ejected from nozzle orifices to produce an article. In a case where the fluid comprises ink, the fluidic die may be implemented as a printhead with the article being a printed image. An actuation event, as used herein, may refer to individual or concurrent actuation fluid actuators to cause fluid displacement, including ejection of fluid from a nozzle.

In example fluidic dies, the array of fluid actuators may be arranged in sets or groups of fluid actuators, where each set of fluid actuators may be referred to as a "primitive" or "firing primitive", where a number of fluid actuators in a primitive may be referred to a size of the primitive. In one example, each primitive has a same set of addresses, with each fluid actuator of a primitive corresponding to a different address of the set of addresses. In some examples, electrical, thermal, and fluid operating constraints of a fluidic die may limit which fluid actuators of each primitive may be concurrently actuated for a given actuation event. Arranging fluidic actuators into primitives facilitates addressing and actuation of subsets of fluid actuators of the array of fluid actuators which may be concurrently actuated for a given actuation event to remain within operating constraints of the fluidic die.

By way of example, consider a fluidic die having four primitives, with each primitive having eight fluid actuators and a same set of eight addresses (e.g., 0 to 7), with each fluid actuator corresponding to a different address of the set of addresses. In one case, according to one example, the fluidic die may have operating constraints that limit the number of fluid actuators that may be concurrently actuated for a given actuation event to one fluid actuator per primitive, for example. In such case, for a first actuation event, the fluid actuator corresponding to address "0" of each primitive may be actuated, followed by a second actuation event, where the fluid actuator corresponding to the address "1" of each primitive may be actuated, and so on, until the fluid actuators at each address of each primitive may have been actuated. It is noted that such example is provided for illustrative purposes only and that any number of other implementations are possible.

Example fluidic dies may include sensors, or arrays of sensors, to monitor operation of the fluidic die. For instance, thermal sensors may be disposed on the fluidic die to monitor operating temperatures of the fluidic die to ensure that the fluidic die operates within thermal operating constraints of the die. In another instance, each nozzle may include an integrated drive bubble detect (DBD) sensor to measure an impedance through the fluid chamber of the nozzle during actuation of the fluid actuator to determine an operation condition of the nozzle (e.g., whether the nozzle is operating properly or whether the nozzle is blocked or partially blocked).

In some examples, to operate each sensor, a reference circuit generates a reference signal (e.g., a voltage signal or a current signal). Sample and sense circuitry associated with the sensor selectively provides the reference to the sensor and samples (measures) an analog sense signal generated by the sensor in response to the reference signal. In some examples, the analog sense signal may be converted on-die to a digital sense signal by an associated A/D converter.

Circuitry is most dense in a nozzle region of a fluidic die. While a sensor requires a relatively small amount circuit area and is capable of being replicated many times on a fluidic die (e.g., thousands of times), sense architecture, including sample and sense circuitry, A/D converters, and especially reference circuitry to generate analog reference signals, require larger amounts of circuit area, thereby limiting a number of sensors that may be disposed on a fluidic die if replicated for each sensor.

FIG. 1 is a block and schematic diagram of a fluidic die 20, according to one example of the present disclosure, having a sense architecture 30 including plurality of sensors which share global reference circuitry and which is arranged arrays of sensors, where each array of sensors shares corresponding sample circuitry. As will be described in greater detail below, by sharing global reference circuitry and sample circuitry with multiple sensors, sense architecture 30, in accordance with the present disclosure, efficiently utilizes circuit area on fluidic die 20 to enable the implementation of a large number of sensors (e.g., thousands of sensors) on fluidic die 20.

According to one example, sensor architecture 30 includes a global sense block 32 and an array 34 of distributed sense blocks (DSBs), indicated as DSB-1 to DSB-M, with each DSB including a sample circuit 36 and an array 38 of sensors 40. According to one example, each DSB receives a same set of address, A1 to AN, such as via an address bus 50, with each sensor 40 corresponding to a different address of the set of addresses, indicated as A1 to AN.

Each DSB further receives a corresponding enable signal via a set of enable lines 52, indicated as enable signals EN-1 to EN-M, with each enable signal having an enable value or a disable value. According to one example, an enable signal 52 having an enable value activates the corresponding DSB to perform sensing operations, while an enable signal having a disables the corresponding DSB. In one example, only one enable signal 52 may have an enable value an enable value at a time so that only one DSB is activated to perform sensing operations at a given time. In one example, address and enable signal are generated on fluidic die 20 (not illustrated). In one example, address and enable signals are received from an external die controller (not illustrated). In one example, address and enable signals may be provided by on-die address and enable signal controllers (not illustrated).

In one example, global sense block 32 provides an analog reference signal to each DSB, such as via a bus 60, where such analog reference signal may be an analog voltage reference signal or an analog current reference signal, for instance. According to one example, the sample circuit 36 of the DSB corresponding to the enable signal 52 having an enable value provides the analog reference signal from bus 60 to the sensor 40 corresponding to the address on address bus 50 (e.g., address A0 to AN), and provides an analog sense signal generated by the sensor 40 in response to analog reference signal to global sense block 32, such as via a bus 62.

In one instance, for example, each of the sensors 40 may comprise a thermal sensor which, in response to application of an analog reference current signal, generates an analog voltage sense signal which is indicative of a temperature of fluidic die 20 at a location at which the sensor 40 is disposed. In another instance, for example, each sensor may comprise a drive bubble detect (DBD) sensor corresponding to a nozzle on fluidic die 20 (not shown) which, in response to application of an analog reference current signal, generates an analog voltage sense signal which is indicative of an operating condition of the corresponding nozzle.

In one example, global sense block may include an A/D converter 70 to convert the analog sense signal received via bus 62 to a digital sense signal, and provides the digital sense signal via a bus 72, such as to an external die controller, or example. In one instance, the analog reference signal provided by global sense block 32 and the resulting analog sense signal provided from the DSBs to the global sense block 32 may use a same bus (e.g., bus 60) and be temporally controlled.

By employing an array of distributed sense blocks (DSBs) which include an array of sensors sharing sample circuitry, and by sharing a global reference block generating analog reference signals between the DSBs of the array of DSBs, sense architecture 30, in accordance with the present application, efficiently utilizes circuit area on fluidic die 20, and enables the implementation of a large number of sensors (e.g., thousands of sensors) on fluidic die 20. Additionally, the generation of analog reference signals and analog-to-digital conversion is sensitive to electrical noise such as that generated by high voltage switching of fluid actuators in a nozzle region of fluidic die 20. By consolidating analog reference signal generation and A/D conversion in global sense block 32 and sharing such functions with the array of DSBs, sense architecture 30 enables circuitry associated with the generation of analog reference signals and A/D conversion to be instantiated fewer times (e.g., once) on fluidic die 20 and enables such circuitry to be disposed away from the electrically noisy nozzle region.

Figure 2:
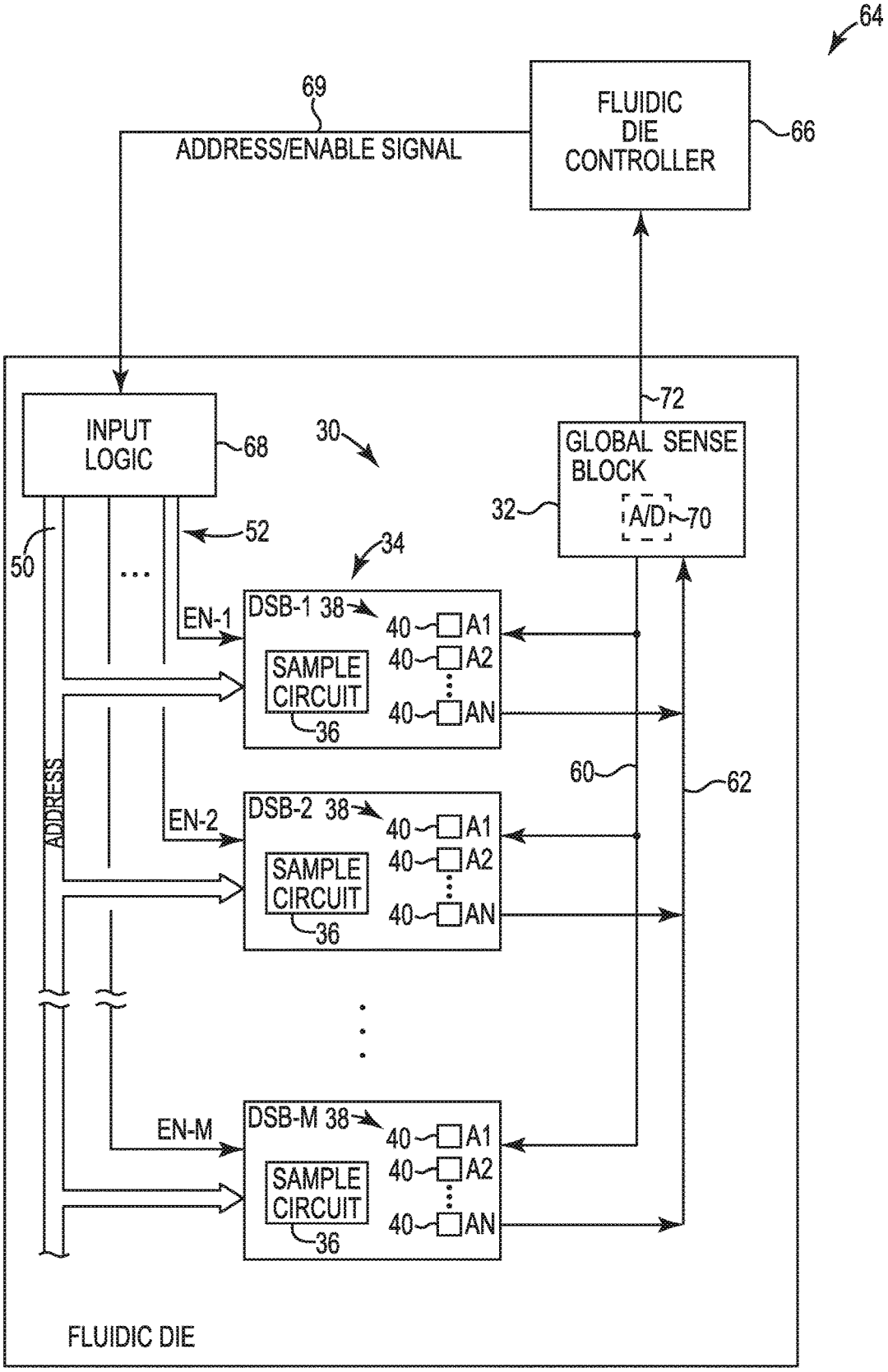
FIG. 2 is a block and schematic diagram generally illustrating a fluidic ejection system including a fluidic die having a sense architecture, according to one example.

FIG. 2 is a block and schematic diagram generally illustrating an example of a fluidic ejection system 64 including a fluidic die controller 66 and a fluidic die 20 having a sense architecture 30 (e.g., as illustrated by FIG. 1), in accordance with the present application. In one example, fluidic die controller 66 provides address data in the form of the set of addresses A1 to AN and enable signal data in the form of the set of enable signals EN-1 to EN-M (each having an enable value or a disable value) to input logic 68 of fluidic die 20 via a communication path 69. According to one example, input logic 68 respectively places the address and enable signal values indicated via communication path 69 on address bus 50 and enable lines 52.

According to one example, fluidic die controller 66 provides enable signal data such that only one enable signal of the set of enable signals EN-1 to EN-M has an enable value (e.g., a value of "1") at a given time, so that only one DSB o the array of DSBs is active at a given time. As described above with respect to FIG. 1, the sample circuit 36 of the DSB corresponding to the enable signal having the enable value applies the analog reference signal provided by global sense block via bus 60 to the sensor 40 of the array of sensors 38 corresponding to the address A1 to AN on address bus 50. Sample circuit 36 samples a resulting analog sense signal generated by the corresponding sensor 40 in response to application of the analog reference signal, and provides the analog reference signal to global sense block 32 via bus 62. In one example, global sense block 32 may communicate the analog sense signal to fluidic die controller 66 via a communications path 72. In one example, A/D converter 70 of global sense block 32 converts the analog sense signal to a digital sense signal and communicates the digital sense signal to fluidic die controller 66 via communication path 72.

Figure 3:
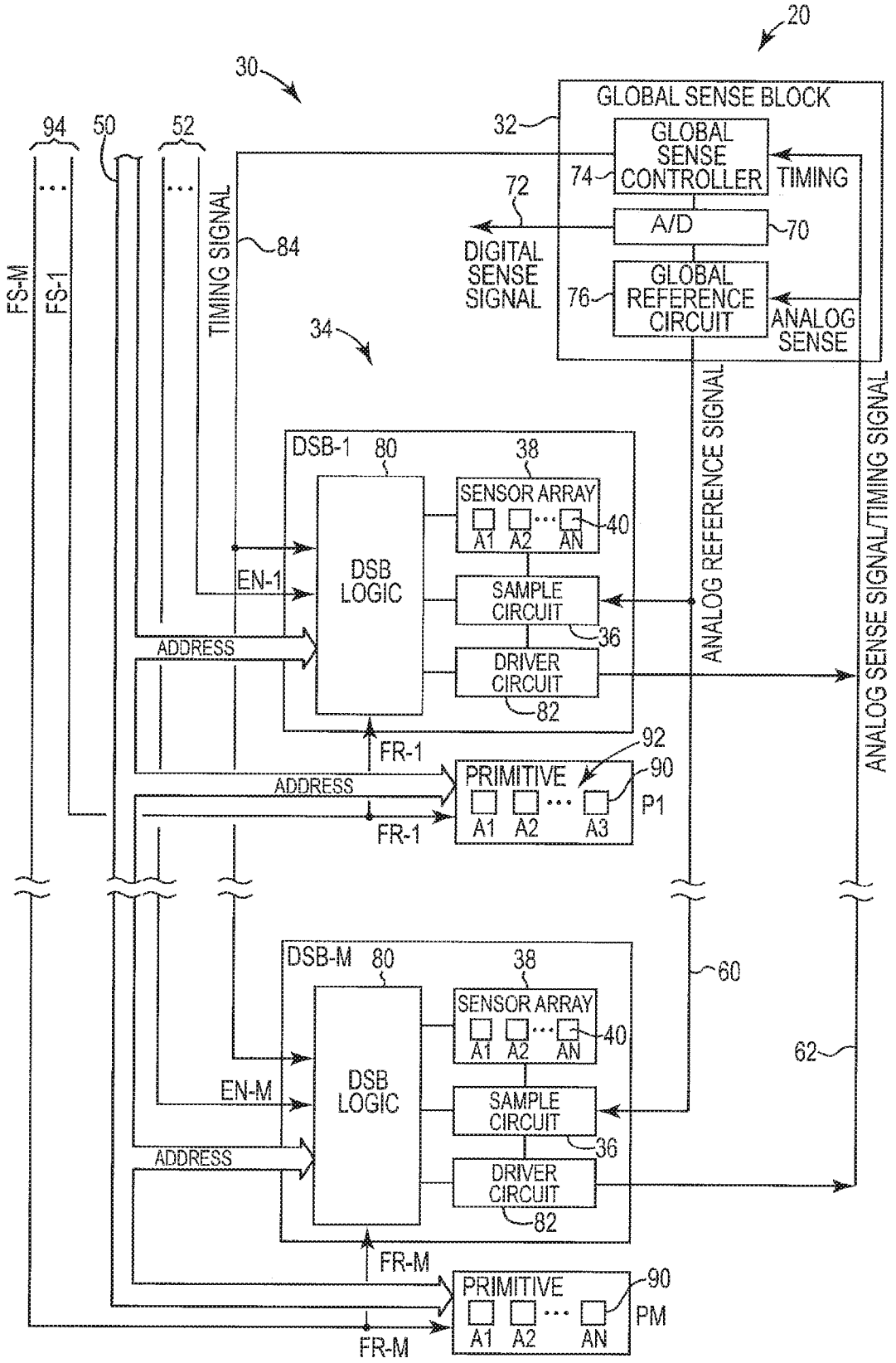
FIG. 3 is a block and schematic diagram generally illustrating fluidic die including sensor architecture, according to one example.

FIG. 3 is a block and schematic diagram generally illustrating fluidic die 20 including sensor architecture 30 according to one example. In one example, in addition to A/D converter 70, global sense block 32 includes a global sense controller 74 and a global reference circuit 76. In addition to sample circuit 36 and sensor array 38, each DSB further includes DSB logic 80 and a driver circuit 82, with the DSB logic 80 of each DSB receiving the corresponding enable signal (EN-1 to EN-B) and timing signals from global sense controller 74 via a bus 84.

According to the example of FIG. 3, fluidic die includes a plurality of fluid ejection nozzles 90 arranged to form a plurality of primitives, illustrated at primitives P1 to PM, with each primitive including an array 92 of nozzles 90. According to one example, each primitive receives the same set of addresses, A1 to AN, via bus 50 as are received by each DSB, with each nozzle 90 corresponding to a different one of the addresses A1 to AN. In example, each primitive, P1 to PM, respectively receives a corresponding fire signal, FS-1 to FS-M, via a set of fire signal lines 94, with each having a fire value or a non-fire value. When the fire signal for a given primitive has a fire value, the nozzle 90 corresponding to the address, A1 to AN, on address bus 50 is initiated to fire so as to eject a fluid drop based on firing data (not shown).

In one example, each DSB corresponds to a different one of the primitives, with DSB-1 to DSB-M respectively corresponding primitives P1 to PM, and with sensors A1 to AN of each sensor array of each DSB respectively corresponding to nozzles A1 to AN of the corresponding primitive. For instance, in one example, each sensor A1 to AN of each primitive comprises a drive bubble detect (DBD) sensor of the corresponding nozzle A1 to AN of the corresponding primitive, where an outgoing signal (e.g., a voltage or current signal) generated by the DBD sensor driven by an analog input signal is indicative of an operating condition of the nozzle.

An example of an operation of sense architecture 30 is described below. According to one example, only one enable signal of the set of enable signals EN-1 to EN-M received via enable lines 52 has an enable value at a given time. For illustrative purposes, consider a scenario where enable signal EN-1 has an enable value, meaning that only DSB-1 of the array of DSBs 34 will be activated and be coupled to global sense block 32. In one example, upon DSB logic 80 of DSB-1 receiving enable signal EN-1 having an enable value (e.g., a value of "1"), DSB logic 80 updates the address provided to the sensor array 38 with the current address on bus 50 and directs sample circuit 36 to receive an analog current reference signal via bus 60.

According to the illustrated scenario, upon firing signal FR-1 having a firing value (e.g., a value of "1") so as to cause firing of the nozzle 90 corresponding to the address on address bus 50 (e.g., A1 to AN), DSB logic 80 directs driver circuit 82 to drive the fire signal local to DSB-1 (in this instance, fire signal FR-1) onto bus 62 so as to be employed as a timing signal by global sense controller 74. In one example, driver circuit 82 may include one or more digital tri-state drivers to drive digital timing signals onto bus 62 and one or more analog drivers to drive analog sense signals onto bus 62.

In one example, upon receiving the timing signal via bus 62 from driver circuit 82, global sense controller 74 provides a sequence of timing signals to DSB logic 50 via timing bus 84 indicating when DSB logic 50 is to instruct sample circuit 36 to apply the analog reference signal from global reference circuit 76 to the selected sensor 40 (i.e., the sensor 40 corresponding to the address on address bus 50), when sample circuit 36 is to sample the resulting analog sense voltage generated by the selected sensor 40, and when driver circuit 82 is to drive the analog sense signal onto bus 62. According to one example, global sense block 32, via A/D converter 70, converts the analog sense signal received from driver circuit 82 via bus 62 to digital sense signal 72. In one case, digital sense signal 72 may be conveyed to an off-die controller (not illustrated).

In one example, buses 60 and 62 may comprise a single bus, with control of when analog reference signals from global reference circuit 76 and timing signals and analog sense signals from driver circuit 82 are placed on the single bus being controlled by global sense controller 74.

In one example, more than one DSB of the array of DSBs 34 may be activated via the set of enable lines 52 (i.e., more than one enable signal EN-1 to EN-M may be have enable value at a given time). According to one example of such a scenario, multiple sets of buses 60, 62, and 84 may be employed to communicate between the multiple activated DSBs and global sense block 32. In some examples the DSBs of the array of DSBs 34 may be grouped into sub-arrays, with one enable signal corresponding to each sub-array, where one DSB in each sub-array may be activated.

In one example, where sensors 40 are not directly associated with or integrated with a nozzle 90 (such as is the case with sensors 40 being DBD sensors), for instance, when sensors 40 comprise thermal sensors, DSB logic 80 of each DSB-1 to DSB-M may not receive a corresponding fire signal FR-1 to FR-M. In such case, initiation of a sensing operation may be initiated by global sense controller 74 via bus 84.

In one example, global sense block 32 may be used with multiple arrays 34 of DSBs (not illustrated). According to such example, each DSB array 34 would have a corresponding set of buses 60, 62, and 84 for communicating with global sense block 32, where global sense block 32 would include multiplexing circuitry to connect with only one set of buses of one array 34 of DSBs at a given time. In other embodiments, each DSB array 34 may be in communication with its own corresponding global sense block 32 (i.e., one global sense block 32 for each DSB array 34).

Figure 4:
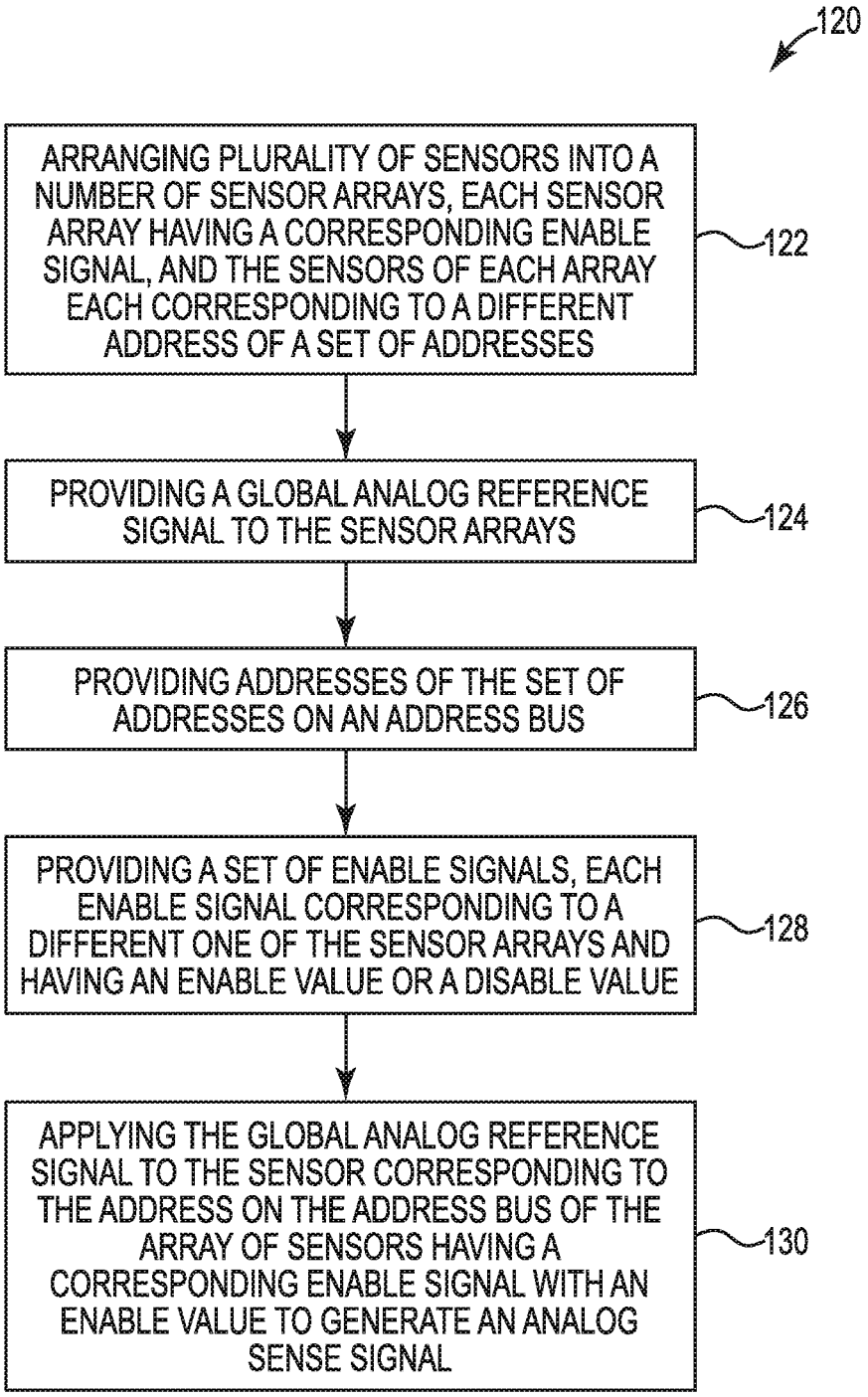
FIG. 4 is a flow diagram generally illustrating a method of operating a fluidic die having a plurality of sensors, according to one example of the present disclosure.

FIG. 4 is a flow diagram generally illustrating a method 120 of operating a fluidic die having a plurality of sensors, according to one example of the present disclosure, such as fluidic die 20 having a plurality of sensors 40, as illustrated by FIG. 1. At 122, method 120 includes arranging the plurality of sensors into a number of sensor arrays, with each sensor array having a corresponding enable signal and a same set of addresses, and each sensor corresponding to a different address of the set of addresses, such as sensors 40 of FIG. 1 being arranged into a plurality of arrays 38, with each sensor 40 of each array 38 corresponding to a different address of the set of addresses A1 to AN, and each array 38 having a corresponding enable signal EN-1 to EN-M.

At 124, the method includes providing a global analog reference signal to the sensor arrays, such as a global analog reference signal being provided by global sense block 32 to each sensor array 38 via bus 60 in FIG. 1. The method, at 126, further includes providing addresses of the set of addresses on an address bus, such as the set of addresses A1 to AN being provided via address bus 50 to each sensor array 38 in FIG. 1.

At 128, the method includes providing a set of enable signals, each enable signal corresponding to a different one of the sensor arrays and having an enable value or a disable value, such as enable signals EN-1 to EN-B respectively corresponding to the sensor arrays 38 of DSBs 1-M of FIG. 1. At 130, method 120 includes applying the global reference signal to the sensor corresponding to the address on the address bus of the sensor array having a corresponding enable signal with an enable value to generate an analog sense signal, such as applying the analog reference signal on bus 60 to the sensor 40 corresponding to the address A1 to AN on address bus 50 and of the array of sensors 38 of the DSB corresponding to the enable signal EN-1 to EN-B having an enable value, as illustrated by FIG. 1. In one example, only one enable signal of the set of enable signals has an enable value at a given time.

Although specific examples have been illustrated and described herein, a variety of alternate and/or equivalent implementations may be substituted for the specific examples shown and described without departing from the scope of the present disclosure. This application is intended to cover any adaptations or variations of the specific examples discussed herein. Therefore, it is intended that this disclosure be limited only by the claims and the equivalents thereof.

The invention claimed is:

1. A fluidic die comprising:
a sense architecture including:
a global sense block to provide an analog reference signal;
an array of distributed sense blocks, each distributed sense block to receive a same set of addresses via an address bus and each to receive a different corresponding sense enable signal having an enable value or a disable value, each distributed sense block including:
an array of sensors, each sensor corresponding to a different address of the set of addresses; and
a sample circuit to:
apply the analog reference signal to the sensor corresponding to the address on the address bus when the corresponding sense enable signal has the enable value; and
provide to the global sense block an analog sense signal from the sensor resulting from application of the analog reference signal.

2. The fluidic die of claim 1, the global sense circuit including an analog-to-digital converter to convert the analog sense signal to a digital sense signal.

3. The fluidic die of claim 1, including at least one bus for communicating the analog reference signal and the analog sense signal between the sample circuit of each distributed sense block and the global sense block.

4. The fluidic die of claim 1, including a timing bus for communicating timing signals from the global sense block to each distributed sense block.

5. The fluidic die of claim 1, including the global sense block providing one of an analog voltage reference signal and an analog current reference signal.

6. The fluidic die of claim 1, including a plurality of arrays of distributed sense blocks, the global sense block including multiplexing circuitry to couple only one array of the plurality of arrays of distributed sense blocks to the global sense block at a time.

7. A fluidic ejection system comprising:
a controller to provide a set of addresses and a set of sense enable signals, each sense enable signal having an enable value or a disable value;
a fluidic die including:
a sense architecture including:
a global sense block to provide an analog reference signal; and
an array of distributed sense blocks, each distributed sense block corresponding to a different enable signal of the set of enable signals, each distributed sense block including:
an array of sensors, each sensor corresponding to a different address of the set of addresses; and
a sense circuit to:
apply the analog reference signal to the sensor corresponding to the address on the address bus when the corresponding sense enable signal has the enable value; and
provide to the global sense block an analog sense signal from the sensor resulting from application of the analog reference signal.

8. The fluidic system of claim 7, including at least one bus for communicating the analog reference signal and the analog sense signal between each distributed sense block and the global sense block.

9. The fluidic system of claim 7, the global sense block to provide an analog signal comprising one of an analog voltage reference signal and an analog current reference signal.

10. A method operating a fluidic die having a plurality of sensors comprising:
arranging the plurality of sensors into a number of sensor arrays with each sensor having a same set of addresses and having a corresponding enable signal, with each sensor of each sensor array corresponding to a different address of the set of addresses;
providing a global analog reference signal;
providing addresses of the set of addresses on an address bus;
providing a set of enable signals, each enable signal corresponding to a different one of the sensor arrays and having an enable value or a disable value; and
applying the global analog reference signal to the sensor corresponding to the address on the address bus of the array of sensors having a corresponding enable signal with an enable value to generate an analog sense signal.

11. The method of claim 10, including providing only one enable signal of the set of enable signal with an enable value at a given time.

12. The method of claim 10, including communicating the analog reference signal and the analog sense signal at different times on a same bus.

13. The method of claim 10, including providing the analog sense signal to a global analog to digital converter to convert the analog sense signal to a digital sense signal.

14. The method of claim 10, including providing a global analog reference signal comprising one of a global analog voltage signal and a global analog current signal.

15. The method of claim 10, including providing a sample circuit for each sensor array, each sample circuit to apply the global analog reference signal to the sensor of the corresponding array having the address on the address bus and to sample an analog signal generated by the sensor in response to the application of the analog reference signal to provide the analog sense signal.

* * * * *